US006065396A

United States Patent [19]

Schiel et al.

[11] Patent Number: 6,065,396

[45] Date of Patent: May 23, 2000

[54] PRESS DEVICE

[75] Inventors: Christian Schiel; Andreas Schuette, both of Heidenheim; Wolfgang Schuwerk, Kisslegg; Joachim Grabscheid, Heuchlingen; Werner Leitenberger, Schlier-Wetzisreute; Uwe Matuschczyk, Geislinger; Christian Steger, Constance, all of Germany

[73] Assignee: Voith Sulzer Papiermaschinen GmbH, Heidenheim, Germany

[21] Appl. No.: 08/950,661

[22] Filed: Oct. 15, 1997

[30] Foreign Application Priority Data

Oct. 16, 1996 [DE] Germany ..... 196 42 733
Dec. 18, 1996 [DE] Germany ..... 296 22 025 U

[51] Int. Cl.[7] ..... D21G 1/00; B30B 3/04

[52] U.S. Cl. ..... 100/153; 100/172; 162/205; 162/358.3; 162/901

[58] Field of Search ..... 100/118, 151, 100/153, 172; 162/205–207, 358.1–358.5, 900, 901

[56] References Cited

U.S. PATENT DOCUMENTS 4,272,317 6/1981 Roerig .
4,273,317 6/1981 Blee .
4,704,191 11/1987 Wedel ..... 100/118
5,427,653 6/1995 Andersson et al. ..... 162/358.3
5,547,547 8/1996 Bengtsson .

FOREIGN PATENT DOCUMENTS 0064933 11/1982 European Pat. Off. .
0583549 2/1994 European Pat. Off. .
9205636 7/1992 Germany .
4323051 12/1993 Germany .
29622025 5/1997 Germany .
450774 7/1936 United Kingdom .
2062041 5/1981 United Kingdom .
95/15413 6/1995 WIPO .

*Primary Examiner*—Stephen F. Gerrity
*Attorney, Agent, or Firm*—Greenblum & Berstein, P.L.C.

[57] ABSTRACT

Press device to treat a fibrous pulp web that may include a shoe press roll and a mating roll. The shoe press roll and the mating roll may be positioned to form a press nip, and at least one endless belt guided through the press nip and forming a substantially non-flexible and rigid drive element at least partially driving the press device.

36 Claims, 2 Drawing Sheets

12

PRESS DEVICE

CROSS-REFERENCE TO RELATED APPLICATION

The present application claims priority under 35 U.S.C. §119 of German Patent Application Nos. 196 42 733.9 filed Oct. 16, 1996 and 29622 025.6 filed Dec. 18, 1996, the disclosures of which are incorporated by reference herein in their entireties.

BACKGROUND OF THE INVENTION

1. Field of the Invention

The present invention relates to a press device for treating a fibrous pulp sheet, in particular, to drain, smooth, or calibrate, e.g., a paper web in a paper machine, in a press nip (gap; opening) formed between a shoe press roll and a mating roll.

2. Discussion of Background Information

In treating fibrous pulp sheets, and, in particular, in draining paper webs, shoe press rolls act together with a mating roll to create a press nip or gap. In certain instances, the mating roll can be formed by another shoe press roll. To ensure gentle draining of the web, and to meet increasing demands of dry content, smoothness, volume, etc., development of these types of devices generally tends toward increasing the shoe lengths. In this manner, a high press impetus or force is to be achieved in the press nip with a minimum pressure gradient and the lowest possible maximum pressure. With increasing press shoe and press are lengths, to prevent a very extreme local bending of the press sleeve acting together with the press shoe, the press nip, subsequent to the press area, should be flattened. This is the general principle of creating a press nip between two shoe press rolls. However, this arrangement also requires new concepts in the drive mechanism.

SUMMARY OF THE INVENTION

The present invention is related to a press device of the type generally described above that creates or provides a required drive capacity, even in a substantially flat press nip, while considering the high demands of draining, smoothing, and calibrating, in particular, e.g., at high speeds.

The present invention guides at least one endless belt through the press nip. The at least one endless belt may be formed as a substantially inflexible and tension proof element for at least a partial driving mechanism of the press device.

A width of the driving belt may be, preferably, substantially similar to the width of the fibrous pulp web and may be formed, e.g., as a water-impermeable belt, in particular, a fabric-reinforced plastic belt or as a metal belt. Alternatively, the driving belt may be formed as a water-absorbing belt and, e.g., may be a press felt belt.

In accordance with the present invention, the press nip may be formed, preferably, as a wide or extended nip press nip via, e.g., two shoe presses. The extended nip may extend substantially horizontally, and a length of the formed press area may be within the range of, e.g., approximately 250 to 600 mm.

In the case of a single drive belt, the drive belt may form a sole drive mechanism, and in the case of several drive belts, the drive mechanism may be, preferably, partially formed by the drive belts. In this regard, a respective driving belt may be guided over at least one guide roll. A spooling angle in a range between, approximately 200° and 220° may be formed, and a friction coefficient, i.e., between the driving belt and the driving roll may be within a range of $\mu$ being between, e.g., approximately 0.2 and 0.4.

Accordingly, the present invention is directed to a press device to treat a fibrous pulp web. The press device may include a shoe press roll and a mating roll, the shoe press roll and the mating roll positioned to form a press nip, and at least one endless belt guided through the press nip and forming a substantially inflexible and tension-proof drive element at least partially driving the press device.

According to another feature of the present invention, the endless belt may have a width substantially the same as a width of the fibrous pulp web.

According to another feature of the present invention, the press device may include two shoe presses associated with the shoe press roll and the mating roll forming the press nip, and the press nip including an extended nip press nip.

According to still another feature of the present invention, the endless belt may be a water-impermeable belt.

According to still another feature of the present invention, the endless belt may be a plastic belt having reinforcements of at least one of carbon fibers, aramide fibers, glass fibers, and metal wires positioned in a run direction of the endless belt.

According to another feature of the present invention, the endless belt may be a metal belt.

According to a further feature of the present invention, the endless belt may include a water-absorbing material. Further, the endless belt may be a press felt web.

According to a still further feature of the present invention, the endless belt may be an elastic endless press belt. Further, the press device may include guide rolls and the elastic endless press belt may be associated with at least one of the shoe press roll and the mating roll and may be guided over the guide rolls.

According to another feature of the present invention, the press nip may extend in a substantially planar form and a length of a press area may be between approximately 250 to 600 mm.

According to still another feature of the present invention, the at least one endless belt may be formed to withstand a belt tension of at least approximately 15 kN/m. Further, the press device may also include two press shoe rolls associated with the shoe press roll and the mating roll to form the press nip and at least one of the two press shoes may be associated with a substantially round roll including an elastic roll sleeve having ends sealed off a press medium.

According to a further feature of the present invention, the press device may include guide rolls and the endless belt may be guided around at least one of the two press shoes and the guide rolls.

According to a still further feature of the present invention, the press nip may form a press zone and a length of the press zone being at least 300 mm. Further, the press zone may be at least 400 mm. Still further, the press zone may be at least 500 mm. Further still, the press zone may be at least 600 mm.

According to another feature of the present invention, the press device may include a drive mechanism including the at least one endless belt. When the at least one endless belt is one endless belt, the drive mechanism is the one endless belt and, when the at least one endless belt is a plurality of endless belts, the drive mechanism is formed by the plurality of endless belts.

According to still another feature of the present invention, the press device may include at least one guide roll and the at least one endless belt may be driven over the at least one guide roll. Further, the at least one guide roll may include a driving guide roll and a spooling angle of the driving guide roll may be between approximately 200° to 270°, and preferably, the spooling angle may be approximately 240°.

According to a further feature of the present invention, a friction coefficient $\mu$ between the at least one endless belt and the driving guide roll may be between approximately 0.2 and 0.4, and preferably the friction coefficient $\mu$ is approximately 0.3.

According to a still further feature of the present invention, press device may include a first and second driven guide roll, the second driven guide roll having a diameter different than the diameter of the first driven guide roll. The first and second driven guide rolls may be spaced apart a distance less than a distance corresponding to a smaller of the diameters of the first and second driven guide rolls. Further, the first and second driven guide rolls may be pressed against each other in an arrangement to increase a power flux. Alternatively, a first and second roll bearing may be respectively associated with the first and second driven guide rolls and the first and second roll bearings may automatically press the first and second rolls against each other due to belt tension.

According to another feature of the present invention, the treatment of the fibrous pulp web may include at least one of draining, smoothing, and calibrating a paper web.

The present invention is also directed to a press device for processing a fibrous pulp web in a web production machine. The press device may include a first roll, a second roll, an extended length press nip adapted to treat the fibrous pulp web formed between the first and second rolls, and at least one belt that may be substantially non-flexible and guided over one of the first and second rolls and through the ended length press nip to at least partially drive the press device.

According to another feature of the present invention, the press device may include guide rolls around which the at least one belt may be guided. The at least one belt may be guided around the guide rolls with a spooling angle of between approximately 200° and 270°.

According to still another feature of the present invention, the press device may also include a drive mechanism that drives the at least one belt. The drive mechanism may include two guide rolls positioned apart a distance less than a diameter of a smaller of the two guide rolls. Further, the two guide rolls may be positioned in opposing contact with the at least one belt.

According to yet another feature of the present invention, at least one of the two guide rolls being rotatably drivable. Further, the at least one rotatably drivable guide roll may be the guide roll having a larger diameter.

Other exemplary embodiments and advantages of the present invention may be ascertained by reviewing the present disclosure and the accompanying drawing.

BRIEF DESCRIPTION OF THE DRAWINGS

The present invention may be further described in the detailed description which follows, in reference to the noted drawing by way of non-limiting example of a preferred embodiment of the present invention, and wherein.

DETAILED DESCRIPTION OF THE PRESENT INVENTION

Figure 1:
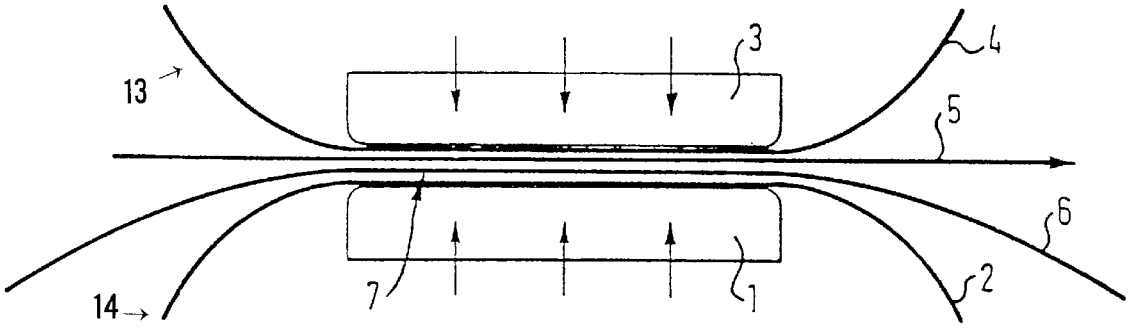
FIG. 1 illustrates a press device formed by two shoe press rolls that each include a press shoe and an elastic, circulating cylindrical roll sleeve.

The particulars shown herein are by way of example and for purposes of illustrative discussion of the preferred embodiments of the present invention only and are presented in the cause of providing what is believed to be the most useful and readily understood description of the principles and conceptual aspects of the invention. In this regard, no attempt is made to show structural details of the invention in more detail than is necessary for the fundamental understanding of the invention, the description taken with the drawing figure making apparent to those skilled in the art how the invention may be embodied in practice.

FIG. 1 illustrates a press device 12 formed by two shoe press rolls 13 and 14. Each of press shoe rolls 13 and 14 may be formed with a press shoe 1 and 3 and a respective elastic, circulating cylindrical roll sleeve 2 and 4. For example, at least one of press rolls 13 and 14 may have a substantially round roll sleeve that is sealed on its ends from the press medium.

Press shoes 1 and 3 may be be pressed against each other with via a suitable pressure device to form or define a press nip (gap; opening) 7 between shoe press rolls 13 and 14. Press nip 7 may be formed as. e.g., a flat nip, in accordance with the shape of press shoes 1 and 3. A web guide belt 6 and, during operation, a fibrous pulp web 5, e.g., a paper web, may be guided through press nip 7. A length of the press area of the flat nip press nip 7 may, preferably lie within a range between, e.g., approximately 250 and 600 mm. In this manner, a gentle treatment of web 5 may be performed with a reduced compression of surface layers of fibrous pulp web 5. Further, press nip 7 may be operated with a high pressure impulse at low pressure gradients.

A drive mechanism of press device 12 may occur solely via web guide belt 6, which may be guided, e.g., over at least one drive roll (not illustrated), e.g., at a spooling angle in a range between, e.g., approximately 200° to 270°, and preferably approximately 240°. Further, required high drive capacities may be addressed with respect to a friction coefficient $\mu$, effective between web guide belt 6 and driving roll, in a range between, e.g., approximately 0.2 and 0.4, and preferably 0.3.

Accordingly, web guide belt 6 may be formed, e.g., as a web with high rigidity (tension resistance) and low flexibility so as to withstand belt tensions of at least, e.g., approximately 15 KN/m, and may include integrated support elements, e.g., carbon fibers, aramide or glass fibers, metal wires, etc., formed in a run direction of web guide belt 6. For example, belt 6 may be formed, e.g., as a water impermeable belt, e.g., a metal belt or a fiber reinforced plastic belt, or, alternatively, as a water absorbing belt, e.g., a press felt web formed of elastic. A low flexibility web guide belt 6 is desired because web guide belt 6 does not undergo too much slippage in looping the drive roll, and, instead of static friction, slippage friction generally occurs.

With the drive mechanism in accordance with the present invention, sufficiently high drive capacities may be incorporated into the press device. In this manner, the drive capacities may, e.g., each measure up to, e.g., approximately 2 kilowatts for each 1 m width at a run velocity of approximately 10 m/min.

Figure 2:
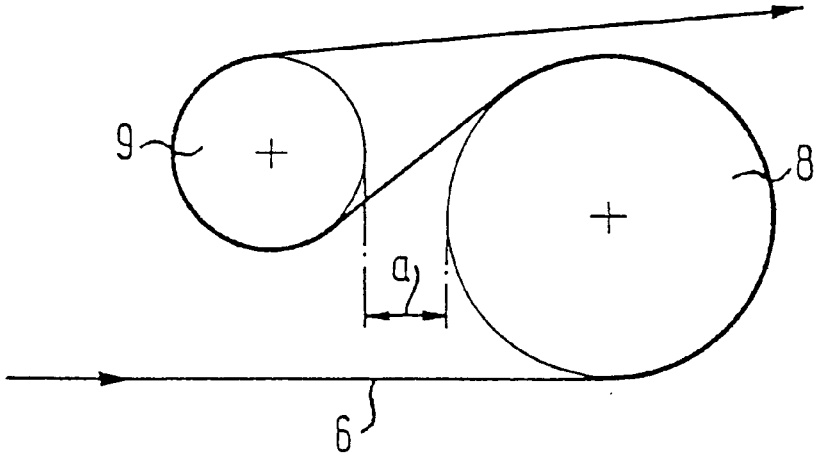
FIG. 2 illustrates an alterative driving mechanism for the driving belt.

FIG. 2 illustrates a schematic display of a drive unit for use with the press device 12. Accordingly, a first guide roll 8 and a second guide roll 9 may be utilized. As shown, first guide roll 8 may have a larger diameter than second guide roll 9, and either guide roll 8 or both guide rolls 8 and 9 may be driven. A relative arrangement of guide rolls 8 and 9 may be selected so that a distance a between guide rolls 8 and 9 may be smaller than the diameter of guide roll 9, i.e., the smaller guide roll. In this manner, advantageous spooling conditions may result.

Figure 3:
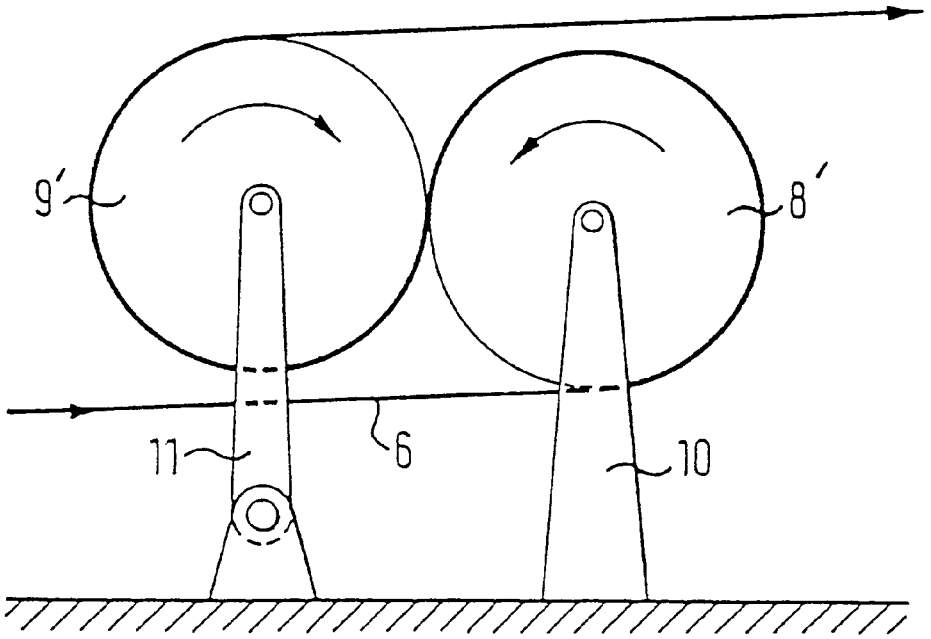
FIG. 3 illustrates a second alternative driving mechanism for the driving belt.

FIG. 3 illustrates a schematic display of a variation of the drive unit depicted in FIG. 2. In accordance with this particular aspect of the present invention, a first guide roll 8' may be positioned in a stationary bearing unit 10 and a second guide roll 9' may be mounted in a pivot bearing 11. Second guide roll 9' may be associated with first guide roll 8 so that one or both guide rolls may be driven. Further, guide rolls 8' and 9' may be. e.g., automatically pressed against each other due to belt tension. Accordingly, guide rolls 8' and 9' may be driven in opposite directions due to spooling of driving belt 6.

It is noted that the foregoing examples have been provided merely for the purpose of explanation and are in no way to be construed as limiting of the present invention. While the invention has been described with reference to a preferred embodiment, it is understood that the words which have been used herein are words of description and illustration, rather than words of limitation. Changes may be made, within the purview of the appended claims, as presently stated and as amended, without departing from the scope and spirit of the invention in its aspects. Although the invention has been described herein with reference to particular means, materials and embodiments, the invention is not intended to be limited to the particulars disclosed herein; rather, the invention extends to all functionally equivalent structures, methods and uses, such as are within the scope of the appended claims.

REFERENCE LIST

1 press shoe
2 roll sleeve
3 press shoe
4 roll sleeve
5 fibrous pulp web
6 web guide belt
7 press nip
8 guide roll
9 guide roll
10 rigid bearing unit
11 pivot bearing unit

What is claimed is:

1. A press device to treat a fibrous pulp web comprising:

a shoe press roll;

a mating roll, the shoe press roll and the mating roll positioned to form a press nip;

at least one driving guide roll;

at least one endless belt guided through the press nip and forming a substantially inflexible and tension-proof drive element at least partially driving the press device;

the at least one endless belt being driven over the at least one driving guide roll;

wherein a friction coefficient $\mu$ between the at least one endless belt and the driving guide roll is between approximately 0.2 and 0.4, and wherein a spooling angle of the driving guide roll is between approximately 200° and 270°.

2. The press device in accordance with claim 1, the endless belt having a width substantially the same as a width of the fibrous pulp web.

3. The press device in accordance with claim 1, further comprising two shoe presses associated with the shoe press roll and the mating roll forming the press nip; and the press nip comprising an extended nip press nip.

4. The press device in accordance with claim 1, the endless belt being a water-impermeable belt.

5. The press device in accordance with claim 1, the endless belt being a plastic belt comprising reinforcements of at least one of carbon fibers, aramide fibers, glass fibers, and metal wires positioned in a run direction of the endless belt.

6. The press device in accordance with claim 1, the endless belt being a metal belt.

7. The press device in accordance with claim 1, the endless belt comprising a water-absorbing material.

8. The press device in accordance with claim 7, the endless belt being a press felt web.

9. The press device in accordance with claim 1, the endless belt being an elastic endless press belt.

10. The press device in accordance with claim 9, further comprising guide rolls; and the elastic endless press belt being associated with at least one of the shoe press roll and the mating roll and being guided over the guide rolls.

11. The press device in accordance with claim 1, the press nip extending in a substantially planar form and a length of a press area being between approximately 250 to 600 mm.

12. The press device in accordance with claim 1, the at least one endless belt formed to withstand a belt tension of at least approximately 15 kN/m.

13. The press device in accordance with claim 12, further comprising two press shoe rolls associated with the shoe press roll and the mating roll to form the press nip; and at least one of the two press shoes being associated with a substantially round roll comprising an elastic roll sleeve having ends sealed from a press medium.

14. The press device in accordance with claim 13, further comprising guide rolls;

the endless belt being guided around at least one of the two press shoe rolls and the guide rolls.

15. The press device in accordance with claim 1, the press nip forming a press zone; and a length of the press zone being at least 300 mm.

16. The press device in accordance with claim 15, the press zone being at least 400 mm.

17. The press device in accordance with claim 15, the press zone being at least 500 mm.

18. The press device in accordance with claim 15, the press zone being at least 600 mm.

19. The press device in accordance with claim 1, further comprising a drive mechanism comprising the at least one endless belt, wherein when the at least one endless belt is one endless belt, the drive mechanism is the one endless belt, and wherein when the at least one endless belt is a plurality of endless belts, the drive mechanism is formed by the pluraiity of endless belts.

20. The press device in accordance with claim 1, the spooling angle being approximately 240°.

21. The press device in accordance with claim 1, the friction coefficient $\mu$ is approximately 0.3.

22. The press device in accordance with claim 1, the treatment of the fibrous pulp web comprising at least one of draining, smoothing, and calibrating a paper web.

23. A press device to treat a fibrous pulp web comprising:

a shoe press roll;

a mating roll, the shoe press roll and the mating roll positioned to form a press nip; and at least one endless belt guided through the press nip and forming a substantially inflexible and tension-proof drive element at least partially driving the press device;

a first and second driven guide roll, the second driven guide roll having a diameter different than the diameter of the first driven guide roll; and the first and second driven guide rolls being spaced apart a distance less than a distance corresponding to a smaller of the diameters of the first and second driven guide rolls.

24. The press device in accordance with claim 23, the first and second driven guide rolls are pressed against each other, wherein the arrangement increases a power flux.

25. The press device in accordance with claim 23, further comprising a first and second roll bearing respectively associated with the first and second driven guide rolls; and the first and second roll bearings automatically pressing the first and second rolls against each other due to belt tension.

26. A press device for processing a fibrous pulp web in a web production machine, comprising:

a first roll;

a second roll;

an extended length press nip adapted to treat the fibrous pulp web, the extended length press nip formed between the first and second rolls;

at least one belt being substantially non-flexible and guided over one of the first and second rolls and through the extended length press nip to at least partially drive the press device;

at least one guide roll;

the at least one belt being driven over the at least one guide roll comprising a driving guide roll, wherein a spooling angle of the driving guide roll is between approximately 200° to 270°, and wherein a friction coefficient $\mu$ between the at least one endless belt and the driving guide roll is between approximately 0.2 and 0.4.

27. The press device in accordance with claim 26, the at least one belt being a water impermeable belt.

28. The press device in accordance with claim 26, the at least one belt being a metal belt.

29. The press device in accordance with claim 26, the belt being a plastic belt comprising reinforcing members of at least one of carbon fibers, aramide fibers, glass fibers, and metal wires positioned in a run direction of the belt.

30. The press device in accordance with claim 26, further comprising guide rolls around which the at least one belt is guided.

31. The press device in accordance with claim 30, the at least one belt being guided around the guide rolls with a spooling angle of between approximately 200° and 270°.

32. The press device in accordance with claim 26, further comprising a drive mechanism that drives the at least one belt.

33. A press device for processing a fibrous pulp web in a web production machine, comprising:

a first roll;

a second roll;

an extended length press nip adapted to treat the fibrous pulp web, the extended length press nip formed between the first and second rolls; and at least one belt being substantially non-flexible and guided over one of the first and second rolls and through the extended length press nip to at least partially drive the press device;

a drive mechanism, which drives the at least one belt, comprising two guide rolls positioned apart a distance less than a diameter of a smaller of the two guide rolls.

34. The press device in accordance with claim 33, the two guide rolls positioned in opposing contact with the at least one belt.

35. The press device in accordance with claim 33, at least one of the two guide rolls being rotatably drivable.

36. The press device in accordance with claim 35, the at least one rotatably drivable guide roll being the guide roll having a larger diameter.

* * * * *